US007435155B2

(12) United States Patent
Reinisch et al.

(10) Patent No.: US 7,435,155 B2
(45) Date of Patent: Oct. 14, 2008

(54) ATHLETIC BRA WITH ADJUSTABLE SUPPORT SYSTEM

(75) Inventors: Dana A. Reinisch, Portland, OR (US); Jorge E. Carbo, Jr., Aloha, OR (US); Dobriana Gheneva, Portland, OR (US)

(73) Assignee: Nike, Inc., Beaverton, OR (US)

( * ) Notice: Subject to any disclaimer, the term of this patent is extended or adjusted under 35 U.S.C. 154(b) by 521 days.

(21) Appl. No.: 11/111,775

(22) Filed: Apr. 22, 2005

(65) Prior Publication Data

US 2006/0252346 A1 Nov. 9, 2006

(51) Int. Cl.
*A41C 3/00* (2006.01)

(52) U.S. Cl. ..... 450/59; 450/76

(58) Field of Classification Search ..... 450/2, 450/4, 39–41, 53–57, 59, 62–64, 75, 76
See application file for complete search history.

(56) References Cited

U.S. PATENT DOCUMENTS 6,165,045 A * 12/2000 Miller et al. ..... 450/1

7,089,597 B2 * 8/2006 Horii et al. ..... 2/69

OTHER PUBLICATIONS

"Shock Absorber" Impact Level 3 Anti-Bounce Sports Bra, date unknown.

* cited by examiner

*Primary Examiner*—Gloria Hale
(74) *Attorney, Agent, or Firm*—Plumsea Law Group, LLC

(57) ABSTRACT

An athletic bra having a unitary, contiguous framework made of engineered laminated material and molded cups provides lightweight, breathable support and motion control. The framework comprises stretch, non-stretch and reinforcement zones in different areas of the bra and includes an integrated chest band, shoulder straps and a front exoskeleton onto which the molded cups are attached. The exoskeleton comprises an adjustable compression strap extending across the front and downward to a front central point of the chest band. The compression band provides adjustable compression and support and full separation of the breasts. The molded cups and exoskeleton achieve both encapsulation of each breast and compression of the breasts for motion control. The adjustment areas of the compression strap, the shoulder straps, and the back closure area provided with a robust hook which is selectively received into a series of adjustment slots or aligned perforations.

87 Claims, 6 Drawing Sheets

ATHLETIC BRA WITH ADJUSTABLE SUPPORT SYSTEM

BACKGROUND OF THE INVENTION

1. Field of the Invention

An athletic bra with an exoskeleton support structure including an adjustable compression strap and molded cups to both encapsulate and compress the breasts to maximize support, comfort and motion control during athletic activities.

2. Background of the Invention.

Women participating in athletic activities have long needed appropriate athletic bras to protect delicate breast tissue from damage and stretching due to inadequate support, excessive motion and bounce while at the same time providing comfort during all activities. There is also a need to compress and encapsulate the breasts to inhibit the bouncing motion inherent in running or jumping activities. Encapsulation provides support and breast separation. Compression of the breasts may also be preferred to prevent the breasts from impeding or interfering with certain movements, such as a golf swing.

In addition to these functional attributes, an athletic bra must also meet the subjective criteria of fit and comfort. Even though women come in all shapes and sizes, and even differing shapes in the same size, some typical athletic bras provide no adjustment at all and are offered only with Small, Medium, Large sizing. Other athletic bras which are sized by rib and cup sizes, only mirror the sizing and fit offered in regular bras and offer only the chest circumference adjustment and shoulder strap adjustments as regular bras.

Some typical athletic bras offer some amount of support to female athletes by providing as much compression as possible in the hopes that bringing the breasts as close to the body as possible will minimize bounce. These bras may accomplish maximum compression, but do not address encapsulation for comfort or aesthetics at all. Many of the Small, Medium or Large compression bras which generally have no adjustments are little more than tank tops made of elastic material sized to compress the breasts of the wearer. In general, typical athletic bras err on the side of comfort thereby sacrificing motion control and support. In addition, these tank-type bras leave a lot to be desired in aesthetics since they generally result in a single compressed mass across a woman's chest with no hint of supporting the breasts individually. A functional shortcoming of tank-type bras is that both breasts end up moving together which can mean more motion than necessary for some athletic activities. For many high intensity and/or high impact activities it is desired to provide motion control for each breast separately to avoid excessive bounce and unnecessary motion and transmission of motion between the breasts. Excessive bouncing can be painful and result in damaged and stretched breast tissue. Forcing both breasts to move together only compounds the problem by imparting motion to a larger mass.

A typical athletic bra of an appropriate size provides only one type of fit and support to the wearer. As a result, most women must possess a stable of different athletic bras depending on the activities in which they participate. Most light weight bras while comfortable are not likely to provide sufficient support, and those bras that provide sufficient support are likely to be heavy weight and uncomfortable.

One prior art bra called the "Shock Absorber" includes an inelastic band that is part of an H-shaped arch on the front extending from the outer side of one breast to the outer side of the other breast. The band appears to extend across the chest from one shoulder strap to the other above the breasts. The arch is not adjustable and is anchored at the sides of the rib band, at the straps and the tops of the cups. It is intended to provide some measure of motion control. However, the inelasticity of the band and lack of support, breast separation and adjustment do not address the fit and comfort criteria. Moreover, while the band may achieve a certain degree of motion control, there is no provision at all for individual encapsulation of the breasts.

Another shortcoming of some prior art bras concerns the materials used and the construction. Although cotton and cotton blends are comfortable materials when dry, they can become heavy and irritating when a wearer perspires during activities. In addition, the elasticity of these materials may be adversely affected by wetness. The prior art has addressed this material problem by using various polyester and other moisture control fabrics. The construction, however, has remained the same: either one uniform material throughout, or different materials and layers pieced together in a typical cut-and-sew construction. A single uniform material will not provide opportunities to customize areas of the bra for elasticity or inelasticity. In bras pieced from multiple pieces of fabric, the exposed sewn seams are often a source of chafing, skin irritation, itching and other discomforts to the wearer.

SUMMARY

The athletic bra of the present invention is different from the prior art in a number of ways. In one aspect of the invention, the athletic bra of the present invention is made of an entirely different construction than prior art bras in the use of an exoskeleton anchoring the cups in the front of the bra. In another aspect of the invention, the bra with the exception of the cups is made of a contiguous engineered laminated material that provides a personal fit by utilizing stretch, non-stretch and reinforcement zones as needed in different areas of the bra.

As for construction, an exoskeleton forms the main structure of the front of the bra onto which the molded cups are attached. The exoskeleton refers to the front framework of the bra that surrounds the cup area and extends across the chest from underarm to underarm, under each breast and meeting in the center. The exoskeleton includes an integral lower chest band and cup periphery onto which the cups are attached. In some embodiments, the exoskeleton also includes a top compression band. The chest band or rib band extends all the way around the ribs and may include a back closure. Attached to the top of the exoskeleton and the rear of the chest band are the shoulder straps. The chest band, top compression band and the shoulder straps are fully adjustable in most sizes of the bra. Molded cups are attached to the exoskeleton frame to complete the bra. Each of the adjustment areas comprise a hook which is selectively anchored to adjustment slots or perforations along the strap and/or band. To maximize the amount of adjustment, a number of adjustment points are provided along each strap.

The material used for the various portions of the athletic bra of the present invention can be thought of as an additional construction element of the bra. The exoskeleton is made of an engineered laminated material having an outer fabric layer, a middle fabric layer and an inner fabric layer which are bonded to each other using a bonding material interposed between each fabric layer. Depending on the area of the bra, the laminated material is modified to provide stretch or non-stretch properties or reinforcement.

One aspect of the invention is to provide an athletic bra with multiple adjustment points to provide a personal fit, enhanced comfort and support. To this end, the rib band includes several slots into which the back hook can be engaged to provide a wide range of rib band adjustment. The shoulder straps are also adjusted by providing hooks on the back of the rib band. Each hook can be received in a series of adjustment slots provided along the rear of each shoulder strap. The Y-shaped element extending along the tops of the cups and forming the top of the exoskeleton is a compression strap or band which attaches to the center front of the chest band. The vertical portion of the compression strap extends downward between the cups to separate the breasts. The compression strap is also adjustable using a hook and series of adjustment holes into which the hook is received. The multiple adjustments of the present invention provide customizable fit and level of comfort and compression depending on the activity of the wearer. For example, for higher impact activities, the wearer may choose to adjust the compression strap tighter to provide more compression than for lighter impact activities.

Another aspect of the invention is to provide an athletic bra that merges the objectives of encapsulation of the breasts and compression of the breasts for enhanced better motion control and support during physical activities. The molded cups are formed of a two layer material in which the two layers are not bonded through most of the cup area except at the periphery. The inner and outer layers are configured to separate the breasts by individually encapsulating each breast to isolate breast motion, thereby reducing unnecessary transmission of motion to both breasts as is the case with most prior art bras.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 5:
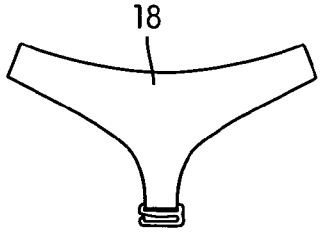
FIG. 5 is a detailed front elevational view of the compression strap.
Figure 6:
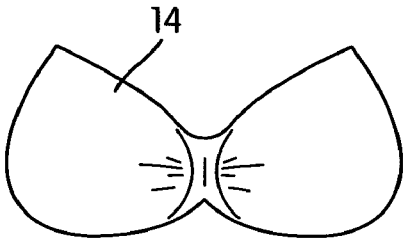
FIG. 6 is a front elevational view of the molded cups.

Athletic bra 10 comprises an exoskeleton 12 and molded cups 14 forming the front of the bra. Broadly, the exoskeleton is the front portion of the bra upon which the cups are attached. In the embodiment shown in FIGS. 1-15, exoskeleton 12 includes a top compression strap. In these embodiments, exoskeleton 12 comprises an integrated chest band or rib band 16 and compression strap 18. The bra is shown on a model in FIGS. 1-3. Exoskeleton 12 is shown in isolation in FIG. 4; compression strap 18 is shown in isolation in FIG. 5; and molded cups 14 are shown in isolation in FIG. 6. The inside of exoskeleton 12 and cups 14 are shown in detail in FIG. 13.

Figure 1:
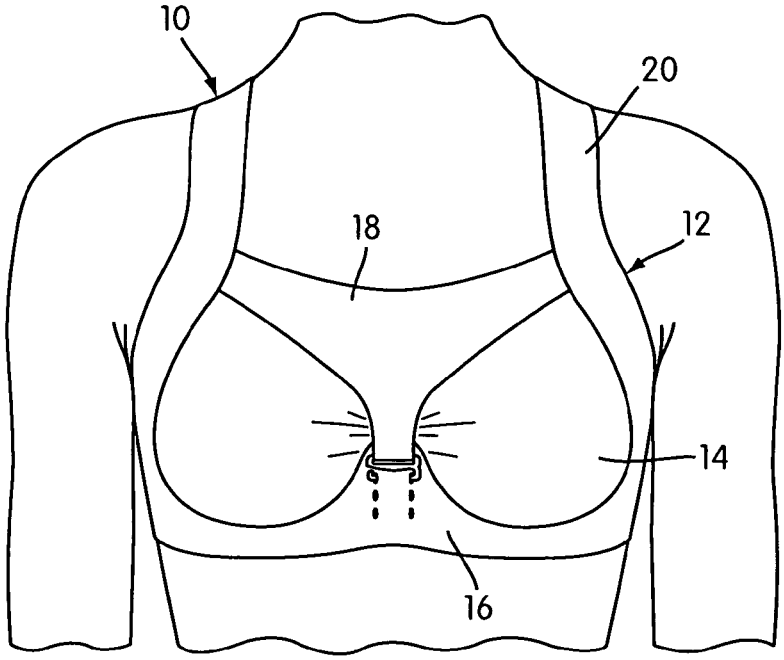
FIG. 1 is a front elevational view of an athletic bra in accordance a first embodiment of the present invention shown on a wearer.
Figure 2:
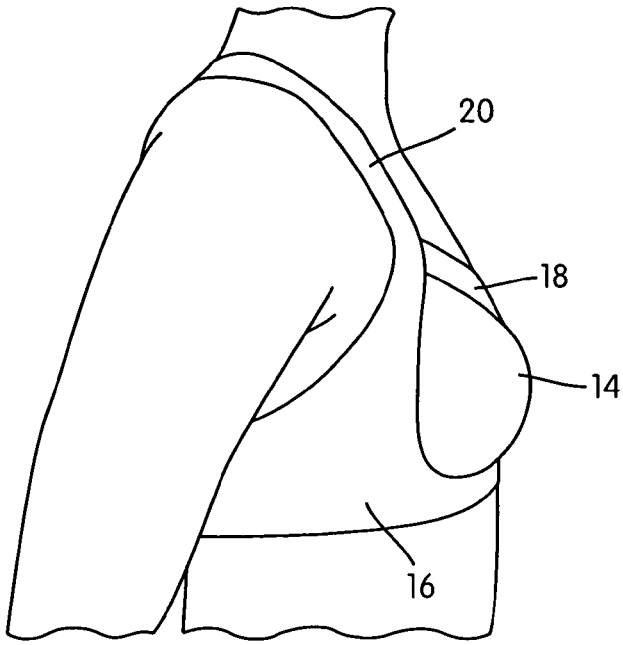
FIG. 2 is a side elevational view of the athletic bra.
Figure 3:
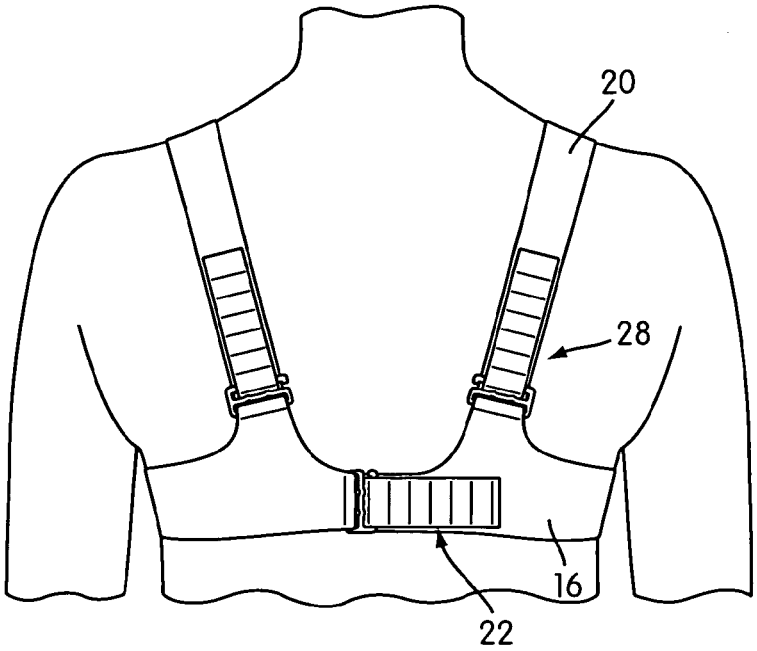
FIG. 3 is a rear elevational view of the athletic bra.

Chest band 16 extends around the entire circumference of the wearer's ribs as seen in FIGS. 1-3. Integrally attached to exoskeleton 12 are shoulder straps 20 that extend upward from the tops of the cups, over the shoulders and attach to the rear of the rib band. Chest band 16 forms the body hugging foundation and includes a back closure 22 comprising a vertically oriented hook 24 and a series of vertical slots 26 into which the hook is received to provide a customized fit for a range of chest circumferences. This back closure is sometimes referred to as the chest strap ladder. The single vertically oriented hook and vertical slots provide an easy on-off mechanism which is faster and easier to operate than the typical series of hooks and eyes on prior art bras. Also hook 24 is a more robust piece of hardware than the typical wire hooks and eyes which are apt to warp and bend after repeated use. Vertical slots 26 are produced by bonding or welding the material of the rib band onto itself at spaced intervals to provide the slots. Any of the adjustment points described herein are synonymously referred to as adjustment ladders or ladders.

Shoulder straps 20 are formed integrally with the chest band and extend upward from the front and over the shoulders. In the embodiment shown in FIGS. 1-12, shoulder straps 20 extend from the front, over the shoulders and downward to meet the rib band in the back. In the embodiment shown in FIG. 13, shoulder straps 20 criss-cross in the back to meet the rib band. In both illustrated embodiments, each shoulder strap has individual adjustment points 28 each comprising an horizontally oriented hook 30 received in adjustment slots 32, FIG. 9. A series of adjustment slots 32 are provided on each of the shoulder straps to provide several points of adjustment. This enables the wearer to customize the fit of the bra for comfort and a particular activity. The hook and slot type of adjustment of the shoulder straps provides a sure and fixed attachment point in contrast to the sliding buckle mechanisms found on shoulder straps of most bras. The sliding buckles frequently slip and causing the wearer to adjust the shoulder straps repeatedly.

Fixed length, non-adjustable shoulder straps may be employed as well. This is particularly true when the bra is made in a pull-over style. It may also be true if the bra is constructed for smaller bust sizes.

Figure 4:
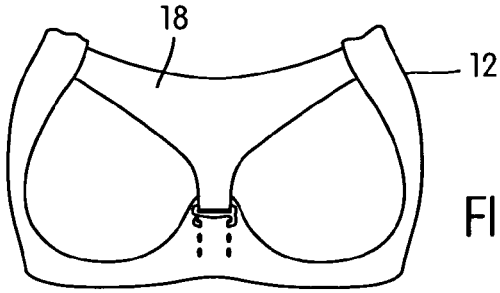
FIG. 4 is a front elevational view of the exoskeleton of the athletic bra of FIG. 1.
Figure 7:
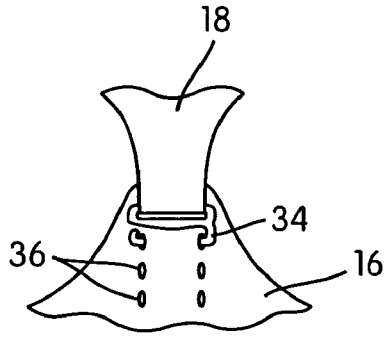
FIG. 7 is a detailed view of the adjustable attachment point for the compression strap.
Figure 8:
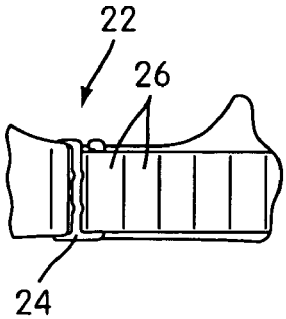
FIG. 8 is a detailed view of the adjustable attachment point for the chest band.
Figure 9:
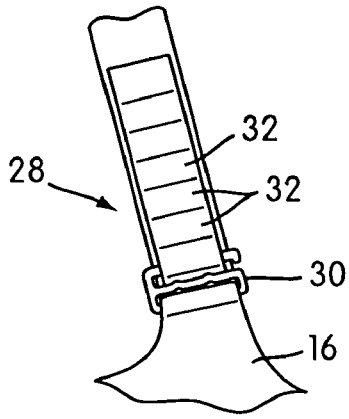
FIG. 9 is a detailed view of the adjustable attachment point for a shoulder strap.

Directional compression strap 18 has a flattened Y-shape and extends across the tops of the cups from shoulder strap to shoulder strap. The vertical leg extends downward between the cups to attach to the chest band and thereby separate the breasts. The attachment of the vertical leg to the chest band may be fixed. Alternatively, this attachment is adjustable as shown in FIGS. 1, 4, and 7, for example. In these figures, the bottom of the vertical leg of compression strap 18 has an horizontally oriented hook 34 which engages a pair of aligned adjustment perforations 36 provided in the central portion of chest band 16. A series of aligned perforations 36 are provided for tightening and loosening of the compression strap.

In the context of this application, the "framework" refers to the bra without the molded cups. That is, the framework comprises the exoskeleton, the sides and back of the rib band and shoulder straps. As can be seen from the drawings with the exception of the compression strap, the framework is made from a contiguous piece of engineered material. The framework may be constructed of multiple pieces of material but they are bonded to one another so as to provide a contiguous inner layer and a contiguous outer layer.

Molded cups 14 are attached to exoskeleton 12 and are designed to encapsulate each of the breasts separately. The molded cups, the exoskeleton and the material are designed and work in tandem to provide both encapsulation and compression of the breasts. To fully explain this two-fold function, a description of the novel engineered laminate material is necessary.

The engineered laminate can be thought of as another structural component of bra 10. The material has a number of zones providing varying degrees of stretch and/or reinforcement depending on the location. For purposes of this description, "low stretch" generally refers to materials with 1-10% lycra content; "medium stretch" refers to materials with 10-20% lycra content; and "high stretch" refers to materials with over 20% lycra content. It will be understood by a person of ordinary skill that higher lycra content corresponds to higher recovery power when stretched. In other words, higher lycra content results in a material that requires more energy to pull apart, and therefore higher recovery power. "Non-stretch" refers to materials with no elastic components and therefore negligible stretch characteristics. That is, the material itself is non-stretch and any limited stretch exhibited is a result of mechanical movement in the weave of the fabric.

Figure 11A:
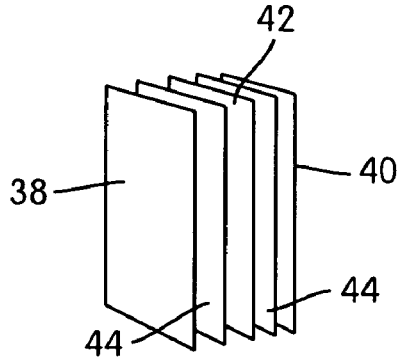
FIG. 11A is a schematic view of the engineered laminated material.
Figure 11B:
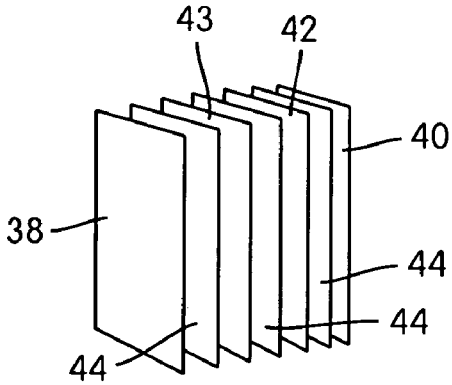
FIG. 11B is a schematic view of the engineered laminate material with reinforcement layer.
Figure 12:
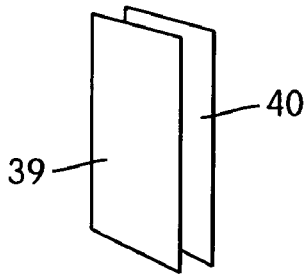
FIG. 12 is a schematic view of the material of the molded cups.

The material zones of the bra will be described in detail below. Each zone has at least two layers of material. Referring to FIGS. 11A, 11B and 12, inner layer 38 that lays against the wearer's skin throughout the bra except for the cups is a non-chafing medium stretch material, such as Dri-FIT™ Tricot using a stretch polyester warp knit fabric. Outer layer 40 throughout the bra is a smooth, non-chafing material with relatively less stretch than the inner layer, such as Dri-FIT™ Tricot using a plain warp knit Lycra™ polyester.

Molded cups 14 are made of only two layers molded at different depths. For the molded cups, outer layer 40 is the same material as the rest of the bra and is molded to be shallower than the inner layer. The layers in the cups are not bonded to each other except at the periphery of the cups where they are attached to the exoskeleton. Inner liner 39 has a softer feel as it is in contact with the most delicate tissue, and also has limited or minimal stretch characteristics. Inner liner 39 is made of a low stretch material such as a stretch polyester warp knit. Since inner liner 39 is less elastic than outer layer 40, molding the inner liner to be deeper results in the less elastic material firmly encapsulating the breast. The shallower outer layer which is more stretchable enhances the compression of the breasts to provide motion control. Compression and encapsulation are further enhanced by the exoskeleton as described below. One advantage of the different molding depths of the inner and outer layers is that the shallower outer layer results in a more attractive retail appearance when the bra is displayed on a hanger because the outer layer retains a tighter shape and provides a smoother appearance.

In most areas of the bra with the exception of the molded cups, the material comprises inner and outer layers 38, 40 with at least one additional middle layer 42 interposed therebetween. Middle layer 42 may be stretch or non-stretch depending on the characteristics desired at a particular location of the bra. These three layers are laminated together by way of bonding layers 44 which are interposed between the each pair of facing fabric layers, FIG. 11A. Each of the layers of the laminated material has its own individual stretch properties, and bonded together, the resulting laminated material will have a stretch property that is an amalgam of the component layers. The degree of stretch in middle layer 42 imposes a controlling factor over the stretch properties of the resultant laminated material, particularly when middle layer 42 is a non-stretch material. The stretch properties of all of the layers of the laminated material are to be considered when determining the various stretch and non-stretch zones.

In some areas of the bra framework middle layer 42 is a non-stretch material. Referring to FIG. 3, middle layer 42 is preferably non-stretch from the top of the shoulder straps, down the front to the top of the top compression strap. Shoulder strap ladders 28 may also be constructed with a non-stretch middle layer 42 when appropriate for the bra size, fit, comfort or activity. Middle layer 42 is also preferably non-stretch along the back chest strap ladder. The front central portion of rib band 16 onto which the vertical portion of top compression band 18 attaches and the areas under each of the molded cups also preferably have a middle layer 42 that is non-stretch. In selected areas where further reinforcement is needed, middle layer 42 is a non-stretch, reinforcement material such as 100% polyester Tricot. In construction terms a non-stretch middle layer is sometimes referred to as a "lock-out" material.

The areas of the bra framework in which middle layer 42 is a stretch material are the top and lateral perimeters of each of the molded cups; and the rib cage band from the underarms around to the back closure. In these areas middle layer 42 is preferably a high stretch power mesh material. The stretchiness of these portions of the framework around the molded cups enhances the fit of the bra around the breasts and enhances the encapsulation of each breast.

In certain zones of the bra framework, another middle layer, reinforcement layer 43 is also placed and bonded between inner and outer layers 38, 40, in addition to middle layer 42, FIG. 11B. Reinforcement layer 43 is a non-stretch Tricot fabric. The zones of the bra in which reinforcement layer 43 may be used include the center front between the breasts and the back closure area. Anywhere reinforcement is desired, reinforcement layer 43 can be an added layer in the laminated material.

The stretch and non-stretch zones can be adjusted or changed as necessary for the size of the bra, the level of anticipated activity of the wearer and to enhance fit and comfort.

Although bonding layers 44 are depicted in FIGS. 11A and 11B as sheets of material, it is to be understood that FIGS. 11A and 11B are schematic and are intended to depict the placement of bonding material vis-à-vis the other plies. Bonding layers 44 can be any form of bonding film or fabric bonding compound. The bonding material used may be sheets of material such as bonding layers 44 as depicted, or the bonding material may simply be applied to the other plies in the assembly process and are placed between the other plies in the fabric "sandwich" as shown in FIGS. 11A and 11B.

The engineered laminated material is lightweight, strong, breathable and supportive. In addition, the performance characteristics of the laminated material can be altered by adding a reinforcement ply. Indeed, even in a contiguous piece of material as is used for the bra framework, different portions of the material can be engineered to exhibit different characteristics based on the materials used in the middle of the fabric "sandwich." Another advantage of the laminated material over traditional cloths is that the bra framework can be seamless and unitary. The inner layer of the bra framework that lies against the skin is smooth and contiguous. A preferred method of constructing the bra is to bond the materials together to eliminate as many sewn seams as possible. One preferred embodiment of the bra has no sewn seams at all. The invention contemplates the use of some sewn seams. It is understood that elimination of any sewn seams, bindings or hem stitching on the bra means elimination of the main sources of chafing and irritation.

The independent functions of encapsulation and compression of the breasts is accomplished in the present invention by both the materials used and the construction of the bra. As described above, the breasts are individually encapsulated by the molded cups. Separation is also ensured by way of compression strap 18 which puts a physical barrier between the two breasts. It has been found that individual encapsulation provides independent motion control to each breast, thereby reducing the motion imparted to the breasts by prior art bras by treating the two breasts as a single mass. Compression of the breasts is accomplished by the molded cups and the unique molding of the inner and outer layers. The horizontally oriented portions of compression strap 18 provide an added measure of motion control. Adjustment of compression strap 18 by engagement of hook 34 into a higher or lower set of perforations 36 results in a customized.

The bra framework and molded cups are preferably attached together by bonding. In this way no sewn seams are present which can sometimes increase the likelihood of chafing points along the bra. Of course, the exoskeleton and molded cups may be sewn together as well.

Figure 13:
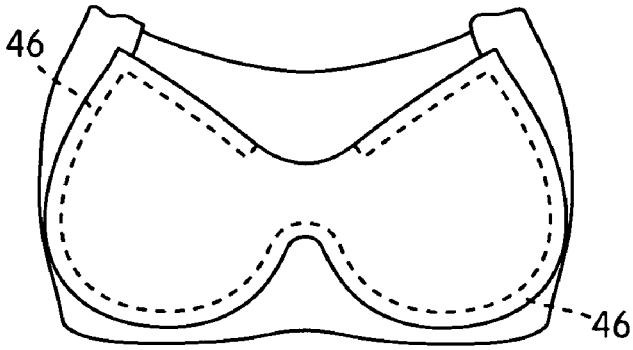
FIG. 13 is an elevational view of the interior of the exoskeleton and molded cups in detail.

A detailed look at the interior of exoskeleton 12 and molded cups 14 is shown in FIG. 13. The dotted lines depict reinforcing areas 46 that are contemplated to be constructed in at least two alternative ways. First, the cup material can be cut so that it will overlap and be bonded to exoskeleton 12 to create a soft build-up of material around each breast to act as a soft underwire-like support material. Second, a strip of reinforcing ribbon material can be added into the engineered laminate of the exoskeleton in reinforcing areas 46 to provide soft underwire-like support around each of the breasts. The dotted lines are not intended to depict stitching, but rather the overlap of material or an additional ribbon of material. Providing this additional support around each breast enhances comfort and support.

Figure 10:
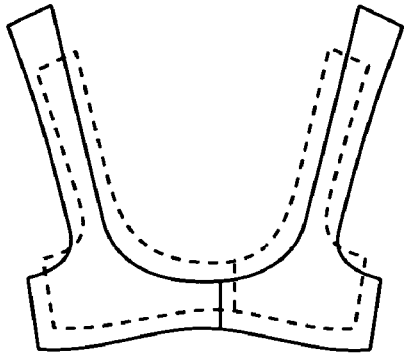
FIG. 10 is a schematic rear view of the athletic bra of FIG. 1 showing two adjustment states.

Fit and support in an athletic bra include both objective and subjective measures. The objective side includes the measured size of the wearer and the amount of motion control which may be monitored by wear testing and plotting motion of the breasts during activity. The subjective side is the wearer's experience while wearing the bra and engaging in athletic activity. Encapsulation of each breast individually and compression of the breasts to achieve motion control improves the fit and support of the bra both objectively and subjectively. FIG. 10 illustrates the same sized bra 10 in two adjusted modes: a solid line version and a dotted line version. FIG. 10 shows schematically the amount of adjustment available to personalize the fit and support of the bra.

Figure 14:
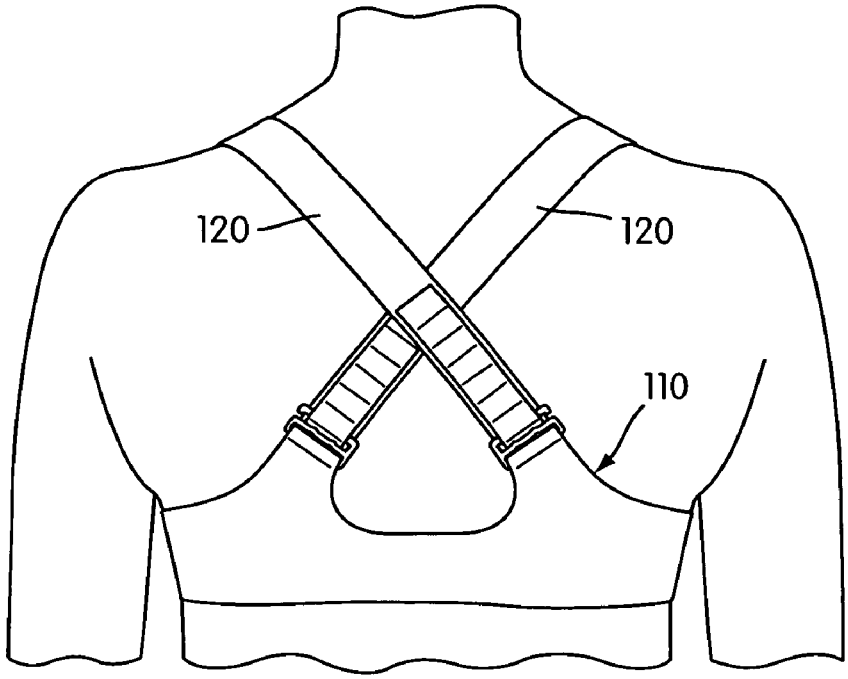
FIG. 14 is a rear elevational view of an alternative embodiment of the athletic bra.

An alternative embodiment of the present invention, bra 110 is shown in FIG. 14 in which shoulder straps 120 criss-cross in the back. This embodiment of the bra is an over-the-head version which does away with a back closure. All other features of the bra such as the front compression strap are the same as the previously described embodiment. In this embodiment, the range of rib size adjustment is limited to the stretch of the rib band since there is no back closure.

Figure 15:
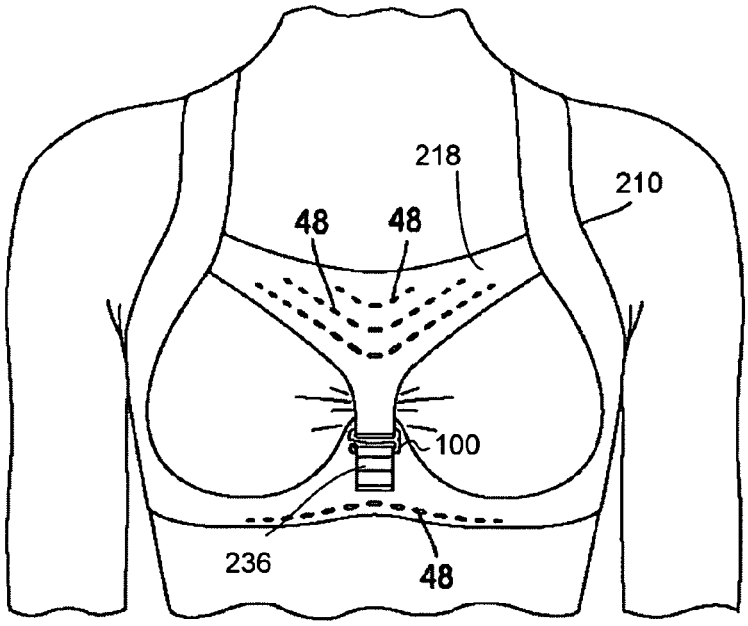
FIG. 15 is a front elevational view of another alternative embodiment of the athletic bra.

Yet another alternative embodiment, bra 210, is shown in FIG. 15. The engineered laminate material enables bra 210 to be equipped with ventilation perforations 48 which are laser perforated through the laminate. Ventilation perforations are shown in the top of the compression strap and along the bottom of the chest band. Of course, ventilation perforations may be provided wherever desired. Depending on the sizes and pattern of the perforations they may impart increased stretch, venting and breathability characteristics to the material. The particular shape of each perforation and the ornamental patterns of the perforations are, however, all a matter of design choice. Bra 210 also illustrates an alternative adjustment area for top compression strap 218. The vertical leg of strap 218 is equipped with hook 34 which selectively engages one of a series of adjustment slots 236. Adjustment slots 236 are substituted for aligned adjustment perforations 36.

Figure 16:
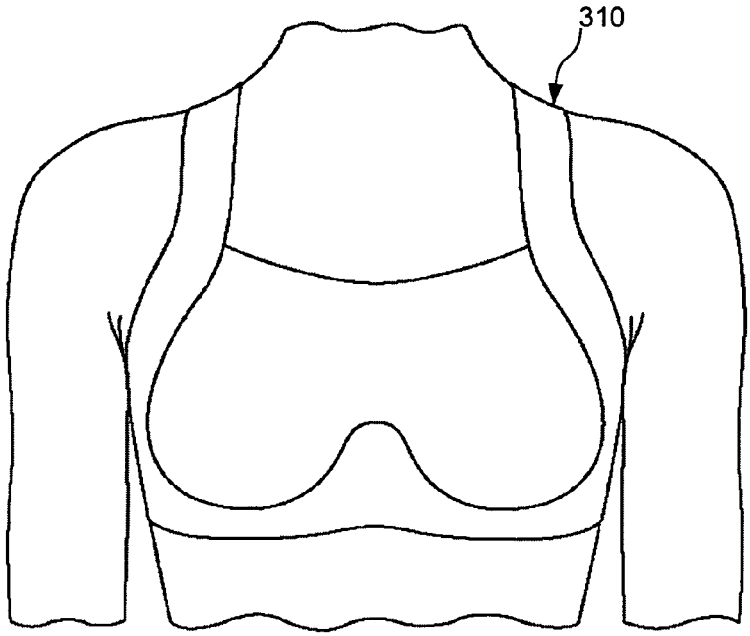
FIG. 16 is a front elevational view of yet another alternative embodiment of the athletic bra.

In yet another alternative, bra 310 is shown in FIG. 16. FIG. 16 illustrates another application of the exoskeleton concept. Exoskeleton 312 forms the front structure of the bra onto which molded cups 314 are attached. Exoskeleton 312 is constructed from the engineered laminated material described above but does not have a top compression strap. The use of an exoskeleton 312 without a top compression strap may be appropriate for certain size ranges of the bra and for certain, lighter impact activities.

The bra depicted in FIG. 16 could also have a top compression strap that is hidden from view. This could be accomplished in at least two ways: place the compression strap on the inside next to the wearer's skin, or place the compression strap between the layers in the laminated material. If the compression strap were placed on the inside, the inside of the bra would resemble the compression strap shown in FIG. 13. A hidden compression strap could also be adjustable by providing the adjustable strap as seen in FIG. 7 to the inside of the bra so that separation of the breasts is not as visible from the outside. Another way of achieving this would be to construct the cups so that an adjustable compression strap lies between the inner and outer layers of the cups to separate the breasts but provide a smooth outer cover over both breasts. This would result in a bra that has the appearance shown in FIG. 16.

It is within the scope of the invention to combine the various alternatives described above in any number of permutations. For example, the bra may have an adjustable compression strap on the exterior as seen in FIG. 1, and a back with criss-crossing straps and no back closure as seen in FIG. 14. The bra may have an adjustable compression strap and a back with no adjustable straps. The bra may have a fixed compression strap attachment with fully adjustable shoulder straps and back closure. A completely non-adjustable bra would have a fixed compression strap attachment or no compression strap as seen in FIG. 16, shoulder straps which are not adjustable and no back closure. Any permutation of the described features is considered to be within the scope of the invention.

The stretch or non-stretch areas described herein refer to one or more preferred embodiments. Depending on the size, the activity level and other factors, the athletic bra of the present invention may be designed with alternative stretch and non-stretch areas. The use of a multi-layered laminated material with layers exhibiting different stretch properties to result in an amalgamated stretch property for the laminated material in any particular area or zone of the garment is contemplated to be within the scope of the present invention.

Athletic bra 10 shown and described is designed for an average C-cup woman. In the United States, 36C is the average bra size. Size 34B is the smallest size that would be made with the exact construction shown in the accompanying drawings. Smaller sizes may have thinner straps; may be made of different material or have less points of adjustment. Larger sizes would have the same points of adjustment, but be made with extra layers in the engineered material; more heavy duty materials; heavier weight materials; or have different transition points between the non-stretch and stretch areas; an extra adjustment notch in the compression strap to enable further compression.

While various embodiments of the invention have been described, it will be apparent to those of ordinary skill in the art that may more embodiments and implementations are possible that are within the scope of the invention.

What is claimed is:

1. An athletic bra having a front portion for covering a wearer's breasts and a back portion for fitting around a wearer's ribs, said bra comprising:

a framework comprising a contiguously formed rib band, a pair of shoulder straps and a front structure of said bra that surrounds a wearer's breasts;

molded cups attached to said front structure and adapted to encapsulate a wearer's breast; and wherein said front structure comprises a top compression strap forming a top border of said molded cups, said top compression strap having a vertical leg extending downward between said molded cups and attached to a front central portion of said rib band to separate a wearer's breasts.

2. The athletic bra of claim 1, wherein said top compression strap is adjustably attached to the front central portion of said rib band.

3. The athletic bra of claim 2, wherein the front central portion of said rib band includes a series of attachment points and said top compression strap includes hardware to selectively engage one of the series of attachment points.

4. The athletic bra of claim 3, wherein said series of attachment points comprises a series of aligned perforations and said hardware comprises a hook.

5. The athletic bra of claim 3, wherein said series of attachment points comprises a series of slots and said hardware comprises a hook.

6. The athletic bra of claim 1, wherein said top compression strap includes a plurality of ventilation perforations.

7. The athletic bra of claim 1, wherein said rib band includes a pair of spaced apart shoulder strap adjustment hooks on a portion of the rib band that extends across a wearer's back, and each of said shoulder straps comprise a series of engagement slots to selectively receive said shoulder strap adjustment hooks.

8. The athletic bra of claim 7, wherein said front structure comprises a top compression strap forming a top border of said molded cups, said top compression strap having a vertical leg extending downward between said molded cups and attached to a front central portion of said rib band to separate a wearer's breasts.

9. The athletic bra of claim 8, wherein said top compression strap is adjustably attached to the front central portion of said rib band.

10. The athletic bra of claim 9, wherein the front central portion of said rib band includes a series of attachment points and said top compression strap includes hardware to selectively engage one of the series of attachment points.

11. The athletic bra of claim 1, further comprising additional material placed on said front structure around said molded cups to provide additional support around the wearer's breasts.

12. The athletic bra of claim 1, wherein said rib band includes an adjustable back closure.

13. The athletic bra of claim 12, wherein said adjustable back closure comprises a vertically oriented hook and a series of vertically oriented slots for selectively receiving said vertically oriented hook.

14. The athletic bra of claim 1, wherein said shoulder straps cross each other in the back portion.

15. The athletic bra of claim 14, wherein said rib band includes a pair of spaced apart adjustment hooks on the back thereof, and each of said shoulder straps comprise a series of engagement slots to selective receive said shoulder strap adjustment hooks.

16. The athletic bra of claim 14, further comprising additional material placed on said front structure around said molded cups to provide additional support around the wearer's breasts.

17. The athletic bra of claim 14, wherein said rib band includes an adjustable back closure.

18. The athletic bra of claim 17, wherein said adjustable back closure comprises a vertically oriented hook and a series of vertically oriented slots for selectively receiving said vertically oriented hook.

19. The athletic bra of claim 1, wherein said framework is formed of a multi-layer laminated material comprising at least an inner layer, a middle layer and an outer layer.

20. The athletic bra of claim 19, wherein said middle layer is a different material in different areas of said front structure to impart varying stretch and support characteristics.

21. The athletic bra of claim 20, wherein said middle layer is a non-stretch material in at least a portion of said rib band.

22. The athletic bra of claim 20, wherein said middle layer is a non-stretch material along at least a portion of each of said shoulder straps.

23. The athletic bra of claim 1, wherein said framework is formed of a multi-layer laminated material comprising at least an inner layer, a middle layer and an outer layer.

24. The athletic bra of claim 23, wherein said middle layer is a different material in different areas of said framework to impart varying stretch and support characteristics.

25. The athletic bra of claim 23, wherein said middle layer is a non-stretch material in at least a portion of said rib band.

26. The athletic bra of claim 23, wherein said middle layer is a non-stretch material along at least a portion of each of said shoulder straps.

27. The athletic bra of claim 23, wherein said middle layer is a non-stretch material in said compression strap.

28. The athletic bra of claim 1, wherein said molded cups are formed of an inner cup liner material and an outer cup layer unattached to one another except along a periphery of each said molded cup.

29. The athletic bra of claim 28, wherein said inner cup liner material is less elastic than said outer cup layer.

30. The athletic bra of claim 1, wherein said molded cups are attached to said front structure by bonding.

31. The athletic bra of claim 1, wherein said molded cups are sewn to said front structure.

32. An athletic bra having a front portion for covering a wearer's breasts and a back portion for fitting around a wearer's rib said bra comprising:

a unitary contiguous framework comprising a rib band, a pair of shoulder straps and an a front structure with a top compression strap extending between said shoulder straps and downward to said rib band at a front central point thereof to separate a wearer's breasts; and molded cups attached to said front structure such that said compression strap extends between said cups, said cups adapted to encapsulate a wearer's breasts individually.

33. The athletic bra of claim 32, wherein said top compression strap is adjustably attached to the front central portion of said rib band.

34. The athletic bra of claim 33, wherein the front central portion of said rib band includes a series of attachment points and said top compression strap includes hardware to selectively engage one of the series of attachment points.

35. The athletic bra of claim 34, wherein said series of attachment points comprises a series of aligned perforations and said hardware comprises a hook.

36. The athletic bra of claim 34, wherein said series of attachment points comprises a series of slots and said hardware comprises a hook.

37. The athletic bra of claim 32, wherein said top compression strap includes a plurality of ventilation perforations.

38. The athletic bra of claim 32, wherein said shoulder straps are adjustable.

39. The athletic bra of claim 38, wherein said rib band includes a pair of spaced apart shoulder strap adjustment hooks on the back thereof, and each of said shoulder straps comprise a series of engagement slots to selective receive said shoulder strap adjustment hooks.

40. The athletic bra of claim 32, further comprising additional material placed on said front structure around said molded cups to provide additional support around the wearer's breasts.

41. The athletic bra of claim 32, wherein said rib band includes an adjustable back closure.

42. The athletic bra of claim 41, wherein said adjustable back closure comprises a vertically oriented hook and a series of vertically oriented slots for selectively receiving said vertically oriented hook.

43. The athletic bra of claim 32, wherein said shoulder straps cross each other in the back portion.

44. The athletic bra of claim 43, wherein said shoulder straps are adjustable.

45. The athletic bra of claim 43, wherein said rib band includes a pair of spaced apart shoulder strap adjustment hooks on the back thereof, and each of said shoulder straps comprise a series of engagement slots to selective receive said shoulder strap adjustment hooks.

46. The athletic bra of claim 43, wherein said rib band includes an adjustable back closure.

47. The athletic bra of claim 46, wherein said adjustable back closure comprises a vertically oriented hook and a series of vertically oriented slots for selectively receiving said vertically oriented hook.

48. The athletic bra of claim 32, wherein said framework is formed of a multi-layer laminated material comprising at least an inner layer, a middle layer and an outer layer bonded together.

49. The athletic bra of claim 48, wherein said middle layer is a different material in different areas of said framework to impart varying stretch and support characteristics.

50. The athletic bra of claim 49, wherein said middle layer is a non-stretch material in at least a portion of said rib band.

51. The athletic bra of claim 49, wherein said middle layer is a non-stretch material along at least a portion of each of said shoulder straps.

52. The athletic bra of claim 49, wherein said middle layer is a stretch material in at least a portion of said front structure.

53. The athletic bra of claim 49, wherein said middle layer is a stretch material in at least a portion of said top compression strap.

54. The athletic bra of claim 49, wherein said middle layer is a non-stretch material in at least a portion of said top compression strap.

55. The athletic bra of claim 32, wherein said molded cups are formed of an inner cup liner material and an outer cup layer unattached to one another except along a periphery of each said molded cup.

56. The athletic bra of claim 55, wherein said inner cup liner material is less elastic than said outer cup layer.

57. The athletic bra of claim 32, wherein said molded cups are attached to said front structure by bonding.

58. The athletic bra of claim 32, wherein said molded cups are sewn to said front structure.

59. An athletic bra having a front portion for covering a wearer's breasts and a back portion for fitting around a wearer's ribs, said bra comprising:

an front structure extending along the front portion and adapted to span from one side of the wearer's chest to the other side;

a rib band integrally attached to said front structure at the sides of the wearer's chest;

a pair of shoulder straps integrally attached to said front structure in the front portion and said rib band in the back portion and adapted to extend over a wearer's shoulders;

molded cups attached to said front structure and adapted to encapsulate the wearer's breast; and wherein said front structure comprises a top compression strap forming the top border of said molded cups.

60. The athletic bra of claim 59, wherein said top compression strap extends across the front portion of said bra and includes a vertical leg extending downward between said molded cups and attached to a lower central portion of said front structure to separate a wearer's breasts.

61. The athletic bra of claim 60, wherein said top compression strap is adjustably attached to the lower front central portion of said front structure.

62. The athletic bra of claim 61, wherein the lower central portion of said front structure includes a series of attachment points and said top compression strap includes hardware to selectively engage one of the series of attachment points.

63. The athletic bra of claim 62, wherein said series of attachment points comprises a series of aligned perforations and said hardware comprises a hook.

64. The athletic bra of claim 62, wherein said series of attachment points comprises a series of slots and said hardware comprises a hook.

65. The athletic bra of claim 59, wherein said top compression strap includes a plurality of ventilation perforations.

66. The athletic bra of claim 59, wherein said shoulder straps are adjustable.

67. The athletic bra of claim 66, wherein in the back portion said rib band includes a pair of spaced apart shoulder strap adjustment hooks, and each of said shoulder straps comprise a series of engagement slots to selectively receive said shoulder strap adjustment hooks.

68. The athletic bra of claim 59, further comprising additional material placed on said front structure around said molded cups to provide additional support around the wearer's breasts.

69. The athletic bra of claim 59, wherein said rib band includes an adjustable back closure.

70. The athletic bra of claim 59, wherein said shoulder straps cross each other in the back portion.

71. The athletic bra of claim 59, wherein said front structure, said rib band, said shoulder straps and said molded cups are formed of a multi-layer laminated material comprising at least an inner layer and an outer layer.

72. The athletic bra of claim 71, wherein said multi-layer laminated material includes a middle layer through said front structure, said rib band and said shoulder straps.

73. The athletic bra of claim 72, wherein said middle layer is a different material in different areas to impart varying stretch and support characteristics.

74. The athletic bra of claim 72, wherein said middle layer is a stretch material in at least a portion of said front structure.

75. The athletic bra of 73, wherein said middle layer is a non-stretch material in at least a portion of said rib band.

76. The athletic bra of claim 73, wherein said middle layer is a non-stretch material in at least a portion of said shoulder straps.

77. The athletic bra of claim 60, wherein said front structure, said rib band, and said shoulder straps are formed of a multi-layer laminated material comprising at least an inner layer, a middle layer and an outer layer.

78. The athletic bra of claim 77, wherein said middle layer is a different material in different areas to impart varying stretch and support characteristics.

79. The athletic bra of claim 78, wherein said middle layer is a stretch material in at least a portion of said front structure.

80. The athletic bra of 78, wherein said middle layer is a non-stretch material in at least a portion of said rib band.

81. The athletic bra of claim 78, wherein said middle layer is a non-stretch material in at least a portion of said shoulder straps.

82. The athletic bra of claim 78, wherein said middle layer is a non-stretch material in at least a portion of said compression strap.

83. An athletic bra having a front portion for covering a wearer's breasts and a back portion for fitting around a wearer's rib, said bra comprising a bra framework and molded cups attached to said framework, said framework constructed from a contiguous multi-layer laminated material having zones of varying stretch; and wherein said framework comprises a top compression strap forming a top border of said molded cups, said top compression strap having a vertical leg extending downward between said molded cups to separate a wearer's breasts.

84. The athletic bra of claim 83, wherein said multi-layer laminated material comprises a first ply, a second ply, and a third ply bonded together to sandwich said second ply, and different materials are employed for said second ply to provide zones of varying stretch.

85. The athletic bra of claim 84, wherein a non-stretch material is employed for said second ply in non-stretch zones of said bra.

86. The athletic bra of claim 84, wherein a stretch material is employed for said second ply in stretch zones of said bra.

87. The athletic bra of claim 84, further comprising a reinforcement material sandwiched and bonded between said first ply and said third ply in predetermined areas of said bra in need of reinforcement.

* * * * *